United States Patent [19]

Iwaoka et al.

[11] Patent Number: 4,858,060

[45] Date of Patent: Aug. 15, 1989

[54] DRIVING DEVICE FOR DOOR LOCK-ACTUATOR

[75] Inventors: Toshio Iwaoka; Masaru Inoue, both of Yokohama, Japan

[73] Assignee: Jidosha Denki Kogyo Kabushiki Kaisha, Kanagawa, Japan

[21] Appl. No.: 131,788

[22] Filed: Dec. 11, 1987

[30] Foreign Application Priority Data

Dec. 16, 1986 [JP] Japan ..... 61-192442[U]

[51] Int. Cl.[4] ..... E05B 47/00

[52] U.S. Cl. ..... 361/185; 340/825.31; 307/10.2

[58] Field of Search ..... 361/171, 172, 185, 189, 361/190, 195, 186, 167; 307/10 AT, 127; 200/61.67; 340/825.31

[56] References Cited

U.S. PATENT DOCUMENTS 4,485,381 11/1984 Lewiner et al. ..... 340/825.31

FOREIGN PATENT DOCUMENTS 58-206016 12/1983 Japan .

*Primary Examiner*—L. T. Hix
*Assistant Examiner*—David M. Gray
*Attorney, Agent, or Firm*—Sughrue, Mion, Zinn, Macpeak & Seas

[57] ABSTRACT

A driving device for a door lock-actuator includes a door locking switch, a control circuit, a drive device and a counter. This device is free from the malfunctions and the restrictions of detecting limits which are problems in conventional-mechanical one-way switches, and can detect the locking and unlocking action certainly. In this device, the control circuit detects the locking and unlocking direction, and the drive device can drive the door lock-actuator of all the doors adjacent a passenger's seat according to the output signal from the control circuit.

1 Claim, 4 Drawing Sheets

DRIVING DEVICE FOR DOOR LOCK-ACTUATOR

BACKGROUND OF THE INVENTION

1. Field of The Invention

This invention relates to a driving device for a door lock-actuator which can be used for an automatic door locking system of an automobile and an automatic door locking system having a keyless entry system.

2. Description of the Prior art

Heretofore, there has been used a door locking system for automobiles which detects the locking and unlocking action separately by using two one-way switches as described in Japanese Published Patent Application No. 58-206016, for example, in order to detect the locking or unlocking action of the door lock by means of operation of a door lock knob on the driver's seat side, a door lock key or a door lock-actuator.

The one-way switch is provided with a movable contactor 103 movable into and out of contact with a pair of terminals 102*a* and 102*b* on a terminal board 101 and an insulator 104 controlling the electric continuity and isolation of said pair of terminals 102*a* and 102*b* on the same axle of a manipulative plate supporting axle 105 as shown in FIG. 5. When the manipulative plate 106 of the one-way switch is turned in one direction, a projection 103*a* provided on the movable contactor 103 and a projection 104*a* provided on the insulator 104 are engaged with each other as shown in FIGS. 6(*a*) and (*b*). By this engagement an insulator turning means R is formed. The insulator 104 turns as a body with the movable contactor 103 within a certain range, and makes said pair of terminals 102*a* and 102*b* contact electrically through said movable contactor 103. Then, an arm 107 of the insulator 104 contacts with the stopper 110*a* of a pair of stoppers 110*a* and 110*b*, and said movable contact 103 turns alone as shown in FIG. 6(*c*). Thus, the engagement of the projection 103*a* of said contactor 103 with the projection 104*a* of said insulator 104 is broken, the movable contactor 103 runs on the insulator 104 and breaks the electric continuity between the terminals 102*a* and 102*b* as shown in FIG. 6(*d*). When the operation is considered correspondingly with the action of the door lock of said door locking system of an automobile, it corresponds to the case where the door lock knob is operated in the down direction.

On the other hand, when the manipulative plate 106 is turned in the other direction from the above-mentioned state, the projection 103*a* of the movable contactor 103 and the projection 104*a* of insulator 104 which constitute the insulator-turning means R are engaged with each other after the turning of movable contactor 103 and thr projection 104*a* of insulator 104 turns as a body with the contactor 103 keeping the electric isolation between said terminal 102*a* and 102*b*, and the arm 107 of the insulator 104 contacts with the other stopper 110*b* of said pair of stoppers 110*a* and 110*b*. As described above, the movable contactor 103 runs on the insulator 104 in the same manner as turning in one direction, the movable contactor 103 turns alone and returns to the original state as shown in FIG. 6(*e*). This working corresponds to the case where the door lock knob is operated in the up direction if it is considered correspondingly to the action of the door lock knob.

Moreover, the above-described one-way switch is used for detecting the locking action of the door lock, the one-way switch used for detecting the unlocking action of the door lock detects the action of the door lock in the direction opposite to the action that can be detected by the one-way switch described above.

However, concerning the conventional one-way switch described above, the projection 103*a* of the movable contactor 103 turns the insulator 104, engaging with the projection 104*a* of the insulator 104 which is restricted in the turning range by the stoppers 110*a* and 110*b*. Accordingly, when the engagement is broken in the state where the projection 103*a* of said movable contactor 103 passed over the projection 104*a* of the insulator 104, the insulator 104 is sprung out in the opposite direction to the turning direction of said movable contactor 103 owing to the elasticity of the movable contactor 103. Therefore, when the manipulative plate 106 is turned in the direction such that the action of the door lock is not detected, there is a problem in that the movable contactor 103 contacts with the terminal 102*a* and makes a pair of terminals 102*a* and 102*b* contact electrically in consequence of an error in the making said movable contactor 103 and the insulator 104, so that a malfunction appears on the one-way switch at the time the projection 103*a* of the movable contactor 103 and the projection 104*a* of the insulator 104 become disengaged.

Although it is possible to make the turning range of the insulator 104 wider for eliminating such a malfunction, in that case there is another problem in that the range in which the movable contactor 103 makes a pair of terminals 102*a* and 102*b* contact electrically becomes narrow as compared with the turning range of the manipulative plate 106.

In the device having two one-way switches such as the door locking system described above, there is a new problem in that the range which the respective movable contactor 103 makes a pair of terminals 102*a* and 102*b* contact electrically becomes narrower because the movable range of the door lock is restricted due to the necessity of enlarging the turning range of the respective insulators 014 of two one-way switches.

SUMMARY OF THE INVENTION

Therefore, this invention is made in view of the aforementioned problems of the prior art and an object of the invention is to provide a driving device for a door lock-actuator which detects a working direction of a door lock without using the one-way switch acting mechanically, and can generate the output of driving instruction of which direction is the same as working direction of the door lock in the driver's seat side to the door lock-actuators of the other doors.

The construction of the driving device for the door lock-actuator according to this invention in order to accomplish the above-mentioned object will be illustrated by a functional block diagram shown in FIG. 1. The driving device for the door lock-actuator has a door locking switch 1 producing a phase difference in the output signal corresponding to the locking or unlocking operation of the door lock, control means 2 giving the first output signal from said door locking switch 1 priority and shutting off the succeeding output signal corresponding to the working if said door locking switch 1, drive means 4 driving a door lock-actuator 3 of all doors except the door on the driver's seat side in the locking or unlocking direction corresponding to the output signal from said control means 2 and count means 5 starting the counting of prescribed time corresponding to the output signal from said control means 2 and switching said drive means 4 into the non-working state after the counting of said prescribed time is completed.

When the door lock is operated in the direction of locking or unlocking with the door lock knob, the door lock key and the door lock-actuator at the driver's seat, the control means 2 detects the action of said door lock to be locked or unlocked according to the output signal from the door locking switch 1 since locking and unlocking direction differ from each other in the first output signal, the driving device for the door lock-actuator according to this invention activates the drive means 4 and the count means 5, and the door lock-actuator of doors except the door in the driver's seat side in the direction of locking or unlocking for the prescribed time.

DETAILED DESCRIPTION OF THE INVENTION

This invention will be described below on the basis of the drawings.

Figure 3:
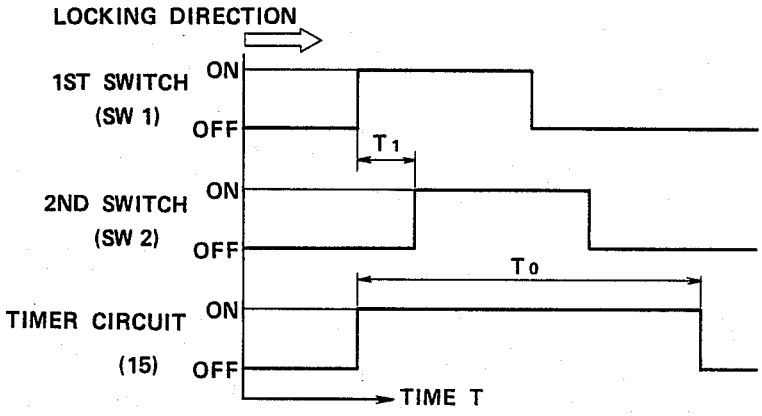
FIG. 3 is a time chart showing the working state in the locking direction of FIG. 2.
Figure 4:
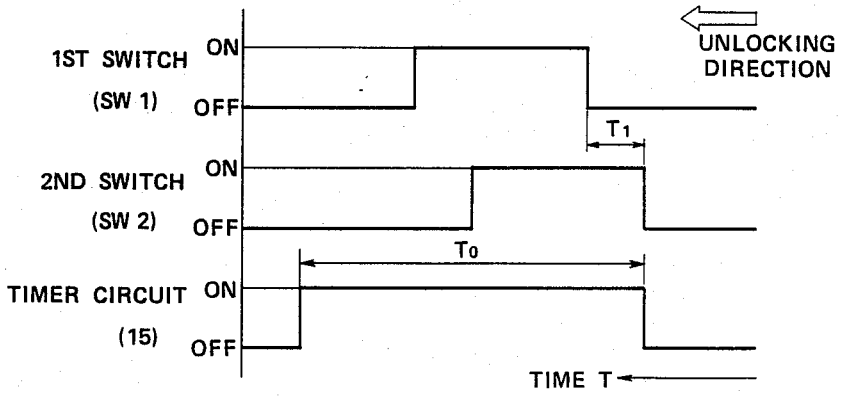
FIG. 4 is a time chart showing the working state in the unlocking direction of FIG. 1.
Figure 2:
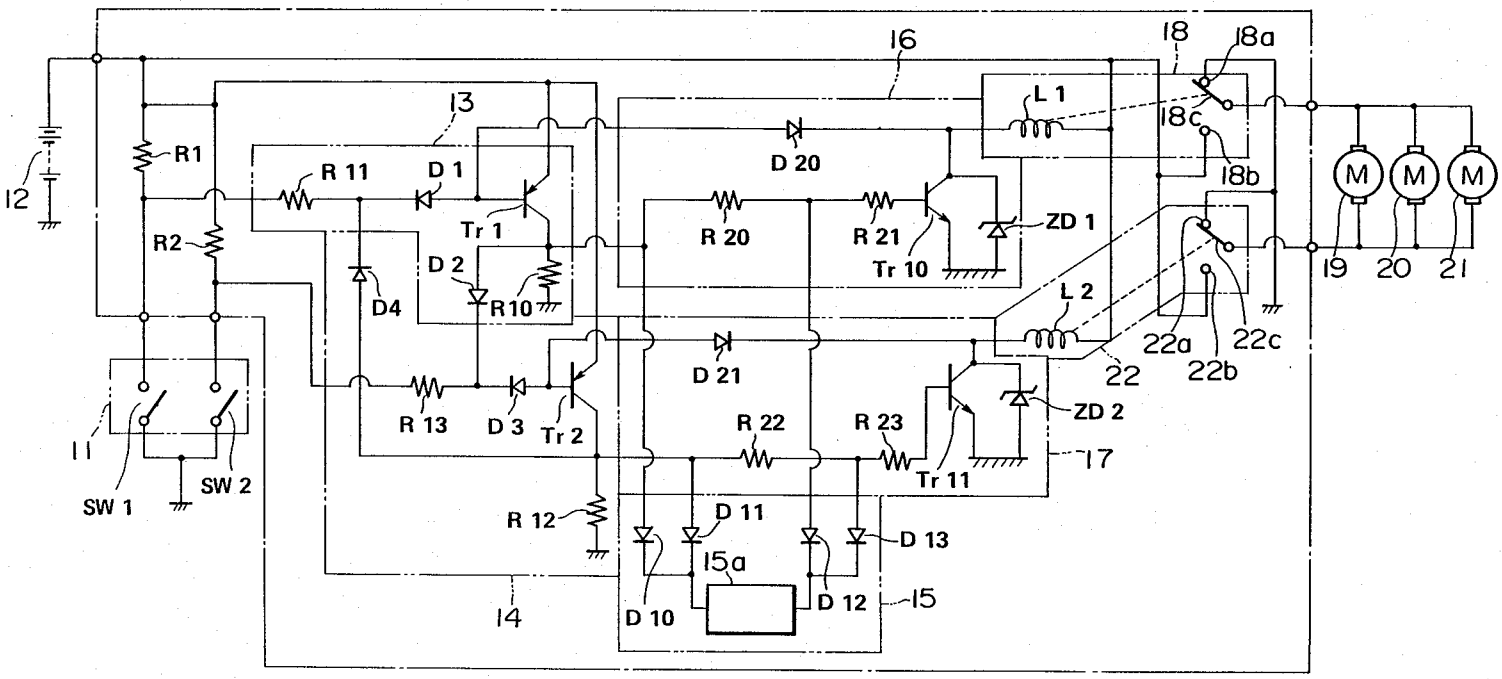
FIG. 2 is a diagram showing the circuit configuration of an embodiment of the driving device for the door lock-actuator according to this invention.
Figure 5:
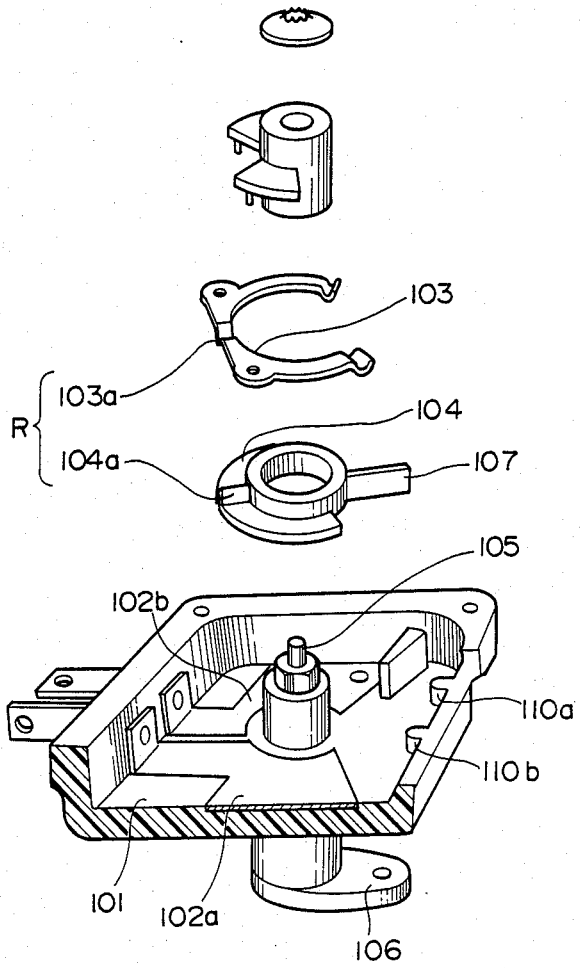
FIG.5 (PRIOR ART)
FIG. 5 is an exploded and perspective illustration showing the construction of a conventional one-way switch.
Figure 6A:
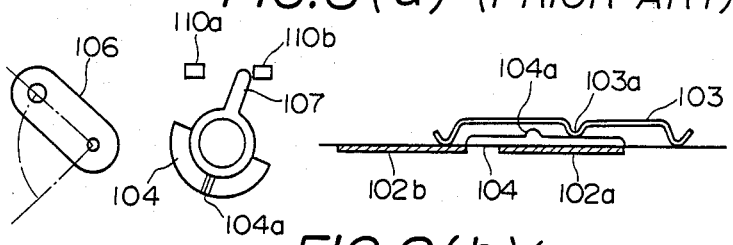
FIG.6(a) (PRIOR ART)
FIG. 6(*a*)–FIG. 6(*e*) are illustrations showing the working states of the switch of FIG. 5 respectively.
Figure 6B:
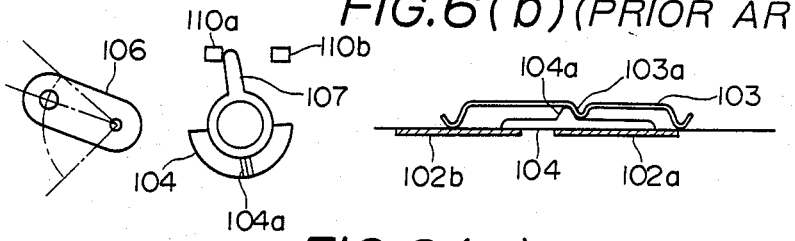
FIG.6(b) (PRIOR ART)
Figure 6C:
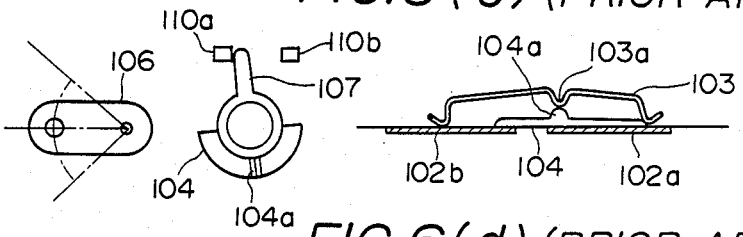
FIG.6(c) (PRIOR ART)
Figure 6D:
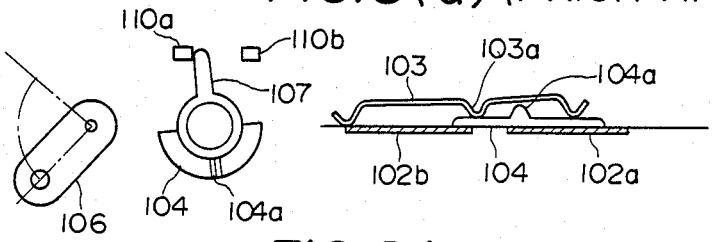
FIG.6(d) (PRIOR ART)
Figure 6E:
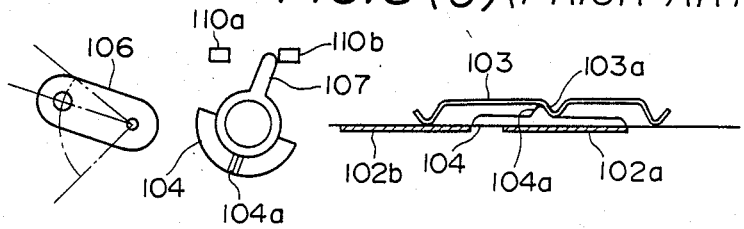
FIG.6(e) (PRIOR ART)

FIGS. 2–FIG. 4 are diagrams showing an embodiment of the driving device for the door lock-actuator according to this invention. FIG. 2 is a diagram showing the circuit constitution of the driving device for the door lock-actuator.

Figure 1:
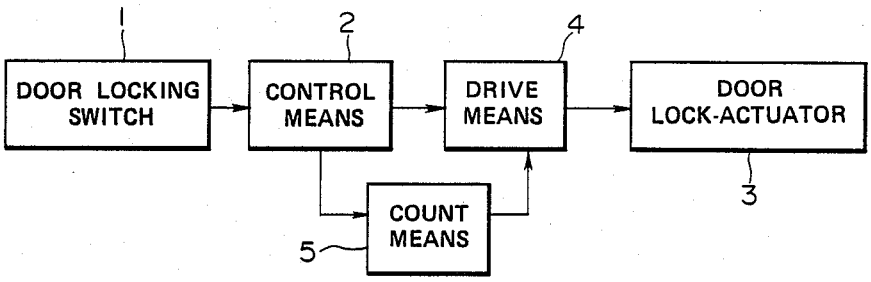
FIG. 1 is a functional block diagram showing the configuration of an embodiment of the driving device for the door lock-actuator according to this invention.

In FIG. 2, numeral 11 is a door locking switch (corresponding to the door locking switch 1 shown in FIG. 1) producing phase difference $T_1$ corresponding to the working direction of the door lock when it is activated in the locking or unlocking direction with the door lock knob or the door lock key provided on the door of the driver's seat side, or the door lock-actuator operated by the centralized door locking switch system or the keyless entry system, or the like. Said door locking switch 11 is provided with the first switch SW1 and the second switch SW2. Phase difference $T_1$ between first switch SW1 and second switch SW2 has an output form as shown in FIG. 3 at the locking operation of the door lock, and has an output form as shown in FIG. 4 at the unlocking operation of the door lock. Furthermore, said first switch SW1 and second switch SW2 are connected to the power source 12 through the resistors R1 and R2 respectively.

Numerical 13 is the first control circuit (corresponding to the control means 2 shown in FIG. 1) operated corresponding to the first ON-state of the first switch SW1 at the locking operation of said door locking switch 11 and making the second control circuit 14 described later into a non-working state. The first control circuit 13 is provided with a PNP transistor Tr1, diodes D1, D2 and resistors R10, R11.

Numeral 14 is the second control circuit (corresponding to the control means 2 shown in FIG. 1) operated corresponding to the first ON-state of the second switch SW2 at the unlocking operation of said door locking switch 11 and making the said first control circuit 13 into a non-working state. The second control circuit 14 is provided with a PNP transistor TR2 diodes D3, D4 and resistors R12, R13.

Numeral 15 is a timer circuit (corresponding to the count means 5 shown in FIG. 1) starting the counting of prescribed time To corresponding to the working of said first control circuit 13 or second control circuit 14. The timer circuit 15 is provided with a timer body 15*a* and diodes D10–D13. Moreover, the prescribed time To is set in a time required for the door lock-actuators provided in the other doors (corresponding to the door lock-actuator 3 shown in FIG. 1) to activate the respective door lock in the direction of locking or unlocking certainly.

Numeral 16 is a locking-drive circuit (corresponding to the drive circuit 4 shown in FIG. 1) driving a locking relay 18 described later corresponding to the working of said first control circuit 13 for prescribed time To counted by said timer circuit 15. The locking-drive circuit 16 is provided with a NPN transistor Tr 10, a zener diode ZD1 protecting said transistor Tr 10, a diode D20 and resistors R20, R21.

Numeral 17 is an unlocking-drive circuit (corresponding to the drive circuit 4 shown in FIG. 1) driving an unlocking relay 22 described later corresponding to the working of said second control circuit 14 for prescribed time To counted by the timer circuit 15. The unlocking-drive circuit 17 is provided with a NPN transistor Tr11, a zener diode ZD2 protecting said transistor Tr11, a diode D21 and resistors R22, R23.

Numeral 18 is a locking relay driving motors 19–21 provided respectively in the door lock-actuators of the doors except the door in the driver's seat side in the locking direction according to the working of said locking-drive circuit 16. The locking relay 18 is provided with a relay coil L1 excited by said locking-drive circuit 16 and a movable armature 18*c* drawn toward the power source side contact 18*b* from the ground side contact 18*a* by the excitation of said relay coil L1.

Numeral 22 is an unlocking relay driving the motors 19, 21 provided in the door lock-actuators of said doors respectively in the unlocking direction according to the working of said unlocking-drive circuit 17. The unlocking relay 22 is provided with a relay coil L2 excited by said unlocking-drive circuit 17 and a movable armature 22*c* drawn toward the power source side contact 22*b* from the ground side contact 22*a* by the excitation of said relay coil L2.

Next, the action of the driving device for the door lock-actuator having the constitution described above will be explained.

In the beginning, the door lock is operated into the locking direction by the means of pushing down the door lock knob in the driver's seat side or turning the door lock key in the locking direction, or activating the door lock-actuator provided on the door in the driver's seat side in the locking direction with the centralized door locking switch system or keyless entry system. Namely, the door lock in the driver's seat side is operated in the direction of the arrow as shown in FIG. 3. In this case, firstly the first switch SW1 becomes in the ON-state, secondly the second switch SW2 becomes in the ON-state at the expiration of prescribed phase difference $T_1$. In brief, at first a circuit of "power source 12→ resister R1→ fist switch SW1 (ON-state) of door locking switch 11→ ground" is formed, secondly a circuit of "power source 12→ resistor R2→ second switch SW2 (ON-state) of door locking switch 11→ ground" is formed at the expiration of phase difference $T_1$.

The base of transistor Tr1 is made to contact electrically with ground through the resistor R11 and the diode D1 in the first control circuit 13 and said transistor Tr1 becomes in the ON-state. Accordingly a circuit of "power source 12→ transistor Tr1 (ON-state) of the first control circuit 13→ resistor R10→ ground" is formed. Thereupon, said transistor Tr1 supplied an electric current to the base of transistor Tr10 through the resistors R20 and R21 in the locking-drive circuit 16, and makes the level of the base of transistor Tr2 in the second control circuit 14 into HI. Therefore, because that transistor Tr2 in the second control circuit 14 cannot become in the ON-state even if the second switch SW2 of the door locking switch 11 becomes in the ON-state, the second control circuit 14 becomes in the non-working state in consequence of giving the first output signal of the door locking switch 11, i.e., ON-signal of the first switch SW1 priority.

Furthermore, when the transistor Tr10 in said locking-drive circuit 16 becomes in the ON-state, a circuit of "power source 12 → relay coil L1 of locking relay 18→ transistor Tr10 (ON-state) in locking-drive circuit 16→ ground" is formed. Hereby, the movable armature **18*c* is drawn toward the power source side contact 18*b* from the ground side contact 18*a* by the excitation of the relay coil L1 of said locking relay 18. Consequently, a circuit of "power source 12→ power source side contact 18*b* of locking relay 18→ movable armature 18*c*→ motors 19–21 movable armature 22*c* of unlocking relay 22→ ground side contact 22*a*→ ground" is formed. Therefore, each of the motors 19–21** of the door lock-actuators provided in the other doors respectively rotate in the locking direction and lock the door locks of all the doors except one in the driver's seat side through the manipulative plate and the rod.

When said first control circuit 13 is operated (i.e., the transistor Tr1 is in the ON-state), the timer body **15*a* is activated and starts the counting of prescribed time To through the diode D10 in the timer circuit 15. When the counting of prescribed time To is finished, the timer body 15*a* stops the supply of a base current to the transistor Tr10 in the locking-drive circuit 16** through the diode D12 and makes the transistor TR10 into the OFF-state. Accordingly, when the prescribed time elapses, the door locks are completely locked by the door lock-actuators provided for the doors adjacent the passenger's seats respectively.

Furthermore, concerning the detection of the locking action of the door lock on the door adjacent the driver's seat side by the locking switch 11, the ON-OFF action is carried out as shown in FIG. 3, at the time that the transistor Tr1 in the first control circuit 13 comes to the ON-state, a circuit of "base of transistor Tr1 in the first control circuit 13→ diode D20 in the locking-drive circuit 16 → collector of transistor Tr10" is formed, and the transistor Tr1 in the first control circuit 13 can maintain the ON-state until the prescribed time To elapses and the transistor Tr10 becomes in the OFF-state.

Next, the unlocking operation of the door lock will be explained.

In the beginning, the door lock is operated in the unlocking direction by means of pulling up the door lock knob adjacent the driver's seat or turning the door lock key in the locking direction, or activating the door lock-actuator provided on the door adjacent the driver's seat in the locking direction with the centralized door locking switch system or keyless entry system. Namely, the door lock adjacent the driver's seat is operated in the direction of the arrow as shown in FIG. 4. In this case, at first the second switch SW2 of the door locking switch 11 comes to the ON-state, secondly the first switch SW1 comes to the ON-state at the expiration of prescribed phase difference $T_1$.

Accordingly, in contrast with the locking operation of the door lock aforementioned, a circuit of "power source 12 → resistor R2 → second switch SW2 (ON-state) of door locking switch 11 → ground" is formed and the base of transistor Tr2 is made to contact electrically with ground through the resistor R12 and the diode D3 in the second control circuit 14, so said transistor Tr2 comes to the ON-state. Consequently, the transistor Tr2 supplies an electric current to the base of transistor Tr11 through the resistors R22 and R23 in the unlocking-drive circuit 17 and makes the level of the base of transistor Tr1 in the first control circuit 13 into HI. In brief, the first control circuit 13 cannot be operated even if the first switch SW1 of the door locking switch 11 comes to the ON-state at the expiration of phase difference $T_1$ in the wake of the second switch SW, and so the unlocking-drive circuit 17 activates the unlocking relay 22 and makes respective motors 19–21 of the door lock-actuator of all the doors except the door in the driver's seat side rotate in the unlocking direction. Therefore, the door lock of all the doors except the door in the driver's seat side results in unlocking.

Thereupon, when the timer circuit 15 starting the counting of prescribed time To corresponding to the working of the second control circuit 14 finishes the counting of prescribed time To, the base of transistor Tr11 in the unlocking drive-circuit 17 is made to the LOW level, the unlocking drive-circuit 17 is switched into non-working state and the unlocking operation of door lock is finished.

Concerning the detection of the locking action of the door lock on the door adjacent the driver's seat by the locking switch 11, the ON-OFF action is carried out in a little while as shown in FIG. 4, a circuit of "base of transistor Tr2 in the second control circuit 14 → diode D21 in the unlocking-drive circuit 17 → collector of transistor Tr11" is formed and the second control circuit 14 can be maintained in the working state as long as the transistor Tr1 in the unlocking-drive circuit 17 maintains the ON-state.

Besides, in the above-mentioned embodiment, the number of door lock-actuators provided in the doors except the door adjacent the driver's seat is three, therefore, this is an explanation of the case of the car of the four-door type. It is clear that the case of the two-door type and the three-door type is also included within the technical scope of this invention.

As mentioned above, the driving device for door lock-actuator according to this invention comprises the door locking switch producing a phase difference in the output signal corresponding to the locking or unlocking operation of the door lock, the control means giving the first output signal from said door locking switch priority and shutting off the succeeding output signals corresponding to the working of said door locking switch, the drive means driving the door lock-actuator of doors adjacent the passenger's seat in the locking or unlocking direction corresponding to the output signal from said control means and the count means starting the counting of the prescribed time corresponding to the 9 output signal from said control means and switching said drive means into the non-working state after the completion of the counting of said prescribed time. Therefore, by using the driving device for the door lock-actuator having the above-mentioned constitution, it is free from the malfunction and the restriction of detecting limit due to the movable range of the door lock which are problems in the conventional-mechanical one-way switch because the control means gives the first output signal from the door locking switch priority and activates the drive means for a prescribed time corresponding to said output signal, and the locking and unlocking action can be detected certainly because it is detected by the electric signal no matter how narrow the movable range of the door lock is. In the conventional door locking system, two one-way switches have been used for detecting the locking and unlocking direction of the door lock respectively, however, in the driving device for the door lock-actuator according to this invention, an excellent effect can be obtained that the control means detects both directions and the drive means can drive the door lock-actuator of all the doors adjacent the passenger's seats according to the output signal.

What is claimed is:

1. A driving device for a door lock-actuator comprising;

at least one door lock actuator adjacent a passenger seat in a car, a door locking switch producing a phase difference in output signals corresponding to a locking or unlocking operation of a door lock adjacent a driver seat in a car, control means for giving a first output signal from said door locking switch priority and shutting off a succeeding output signal corresponding to the working of said door locking switch, drive means for driving the door lock-actuator of said at least one door adjacent a passenger seat in the locking or unlocking direction corresponding to an output signal from said control means, and count means starting the counting of a prescribed time corresponding to the output signal from said control means and switching said drive means into a non-working state after the completion of the counting of said prescribed time.

* * * * *